US005474209A

United States Patent [19]

Vallet Mas et al.

[11] Patent Number: 5,474,209

[45] Date of Patent: Dec. 12, 1995

[54] PHARMACEUTICAL PRODUCT CONTAINER WITH TWO SEPARATE SUBSTANCES AND A MIXING DEVICE AND DOSED DISPENSATION

[75] Inventors: Jose A. Vallet Mas, Barcelona; Francesc X. Gimenez Guasch, Premia De Mar, both of Spain

[73] Assignee: Laboratorios Cusi, S.A., El Masnou, Spain

[21] Appl. No.: 87,612

[22] Filed: Jul. 2, 1993

[30] Foreign Application Priority Data

| | | | |
|---|---|---|---|
| Jul. 2, 1992 | [ES] | Spain | 9202278 |
| Mar. 30, 1993 | [ES] | Spain | 9300651 |

[51] Int. Cl.[6] ..... B67D 5/60

[52] U.S. Cl. ..... 222/83; 222/153.06; 222/153.09; 222/145.6; 206/219; 206/221; 215/DIG. 8

[58] Field of Search ..... 222/80, 81, 83, 222/145, 153; 206/219, 221; 215/DIG. 8; 604/410, 414, 82, 87, 88, 89

[56] References Cited

U.S. PATENT DOCUMENTS

| | | | |
|---|---|---|---|
| 3,802,604 | 4/1974 | Morane | 222/83 |
| 4,203,517 | 5/1980 | Hildebrandt et al. | 215/DIG. 8 |
| 4,465,183 | 8/1984 | Saito et al. | 215/DIG. 8 |
| 4,610,374 | 9/1986 | Buehler | 222/83 |
| 4,682,689 | 7/1987 | Pereiva et al. | 215/DIG. 8 |
| 4,693,366 | 9/1987 | Goncalves | 222/80 X |
| 4,757,916 | 7/1988 | Goncalves | 222/83 |
| 4,982,875 | 1/1991 | Pozzi et al. | 222/83 |

FOREIGN PATENT DOCUMENTS

| | | |
|---|---|---|
| 338349 | 10/1989 | European Pat. Off. . |
| 344849 | 12/1989 | European Pat. Off. . |
| 217425 | 6/1990 | European Pat. Off. . |
| 475789 | 3/1992 | European Pat. Off. . |
| 561322 | 9/1993 | European Pat. Off. . |
| 1568362 | 5/1969 | France . |
| 2170772 | 9/1973 | France . |
| 428893 | 8/1974 | Spain . |
| 8403404 | 3/1983 | Spain . |

*Primary Examiner*—Robert J. Oberleitner
*Assistant Examiner*—Kenneth Bomberg
*Attorney, Agent, or Firm*—Darby & Darby

[57] ABSTRACT

A pharmaceutical product container houses two separate substances. The container includes a bottom container having a first substance. The bottom container has an edge disposed at an open mouth thereof. A top container has a second substance. The top container has a frangible bottom wall. The top container has a flap extending radially outwardly. The flap includes an annular rib. The annular rib has a device for retaining the edge of the bottom container. The top container has a neck portion extending axially remote from the bottom wall. The neck has a helical thread to receive the cap. The neck includes a plurality of radially extending toothed projections about its perimeter. A tubular sleeve is disposed within the top container. The tubular sleeve is axially moveable with respect to the top container. The tubular sleeve has a first end and a second end. The first end has a device for partially cutting the bottom wall of the top container upon rotation of the cap onto the neck to create axial movement of the tubular sleeve in a first direction. The second end terminates with a radially protruding wing and a truncated-cone shaped portion. The truncated-cone shaped portion has a device for functioning as a medicinal dropper. A seal is connected to the cap with a perforated connection. The seal includes a plurality of radially extending toothed projections about its perimeter which mate with the plurality of projections in the neck such that upon rotation of the cap off of the neck, the perforated connection breaks and the seal can be removed. The cap can then be rotated onto the neck to effect the cutting of the bottom wall.

11 Claims, 5 Drawing Sheets

PHARMACEUTICAL PRODUCT CONTAINER WITH TWO SEPARATE SUBSTANCES AND A MIXING DEVICE AND DOSED DISPENSATION

OBJECT OF THE INVENTION

The present invention is directed toward a pharmaceutical product container having two separate substances, a mixing device and a dosage dispenser. The present invention permits the nixing of the two different products, one of which is located inside the bottom container itself, while the other one is located inside a top container which has a weakened frangible member. A tubular sleeve that terminates at the top in a discoidal wing from which it continues in a truncated-cone shaped portion for use as a medicine dropper. The tubular sleeve's bottom terminates in a bevel edge. Upon screwing down a cap, after a tamper evident seal has been removed, the bevel edge of the tubular sleeve is pressed downward to allow partial cutting of the weakened perimeter of the bottom of the top container. This partial cut causes a total opening between both compartments, but prevents the torn bottom from being completely severed from the top container. Thus, the present invention prevents the bottom from moving freely around the inside of the bottom of the container once it has been torn.

Another object of the invention includes providing a retaining device for preventing the removal of the sleeve from the top container, once the bottom thereof has been broken. For the same purpose, a seal between the bottom container and the top container is included in the present invention.

The present invention also utilizes a group of rings and seals that maintain the sealing and invulnerability of the container, both before removal of the seal, maintaining these two features in the components separate, as well as after having broken the seal and having carried out the mixing of the two components, maintaining the final sealing and invulnerability of the inside of the container. Only the discharge of the mixture through the dosing medicine dropper is permitted.

The container according to the present invention permits a final filling and conditioning that is very diverse, permitting for varying the order of filling of the top part and the bottom pan, which prevents crossed contamination, which is a typical problem in the pharmaceutical industry.

BACKGROUND OF THE INVENTION

On the pharmaceutical market in general and especially in the dermic, ophthalmic, oral and nasal sectors, there are multiple products, such as certain eye drops, whose shelf life, once all of the ingredients have been mixed, in most cases does not exceed four weeks.

In view of these circumstances, for some time now the ingredients of the product are grouped in two parts that are packaged separately and independently.

Generally, one of the parts is in a powdered lyophilized form, while the other one is in a liquid state. Each one of the parts maintains individually its stability during the proposed period of validity. The end user himself is the one who must mix both parts when the product is to be administered. The stability of the reconstituted product suffices to guarantee the indicated time of use.

European Patent No. 344,849 and European Patent No. 217,425 provide attempted solutions to this problem.

European Patent No. 217,425 is directed towards a device of this type, in which the mouth of the container has a thread upon which the cap, which is provided with a seal, is retained. Likewise, a cup is pressed on the mouth, inside of which the tubular sleeve is housed. The tubular sleeve terminates at its top edge with a discoidal wing and continues in a truncated-cone shaped portion to carry out the functions of a medicine dropper.

In this patent, after removing the seal from the cap, the cap can be screwed down. The movement of the cap pushes the tubular sleeve, which presses against the bottom of the cup, carrying out the breaking thereof and producing the mixing of both products.

This patent presents the problem that after removing the seal to effect the breaking of the bottom it is necessary to exert a certain effort; at the same time to permit the application of the mixed product it is necessary to press the container. During this pressing step, the discharge of the cup and/or of the tubular sleeve frequently occurs. Thus, all of the product is inadvertently dispensed. This is a serious problem because the correct amount of the product has not been dispensed. This patent also fails to disclose the use of seals, which prevents the use of this patent for mixing of two liquids. This patent also fails to accommodate for the invulnerability of the container, nor for a mechanism that permits the dose to be repeated (fox example, a drop), nor is the versatility of filling and final conditioning of the container set forth.

Concerning European Patent No. 344,84, this patent is directed to a device, in which the cup has an outside coaxial flap that includes an annular rib protruding radially inwardly. The rib retains the cup on the edge of the mouth of the container in such a way that it prevents, when application takes place, the cup from being removed. This feature however, is not necessary in this model given that it does not act as a medicine dropper, because the application of the mixed product is done entirely during treatment. In this patent, the breaking of the bottom is done by pressing the cap and not screwing it, as in the prior patent. Breaking the bottom by pressing creates greater difficultly for breaking the bottom of the cup given that the force to be exerted is much greater. Further, in this patent, the cylindric sleeve may be removed by effecting the application.

SUMMARY OF THE INVENTION

In order to solve the above cited problems in the prior art, the present invention comprises a bottom container consisting of a bottle upon which another top container is placed. After breaking the bottom of the top container, the tubular sleeve remains retained in the top container, which in turn is retained in the edge of the mouth of the bottom container. The tubular sleeve and top container are retained in such a way as to prevent, upon applying the mixed product, removal of either the top container or the tubular sleeve, or of both at the same time. The present invention permits the application of the exact dosed amount of the mixed product desired. The invention has diverse projecting rings, labyrinth-type seals and embossments that ensure a good sealing of the entire device, before and after the breaking of the seal. Likewise, mishandling of the container is prevented by providing seals to maintain invulnerability of the same. Another advantage of the present invention exists in the versatility involved in the filling stage, making it possible to carry out this stage in two separate containers, and in the desired order.

In order to establish these advantages, the top container of the invention is comprised of a coaxial retaining rib that is retained in the edge of the mouth of the bottom container. The top container is also provided with a helical thread to provide the threading of the cap with a perimeter edge to establish the retention of the seal of the cap and of an annular recess in the mouth thereof.

On the inside of the top container, which is made conventionally, a tubular sleeve extends whose top terminates in a discoidal wing. From the wing the top container continues in a truncated-cone shaped portion, which can function as a medicine dropper (depending on whether or not it is of interest in the application). The discoidal wing, in one of the embodiments, advantageously has a certain conicity, to define a bevel that is complemented with an annular recess provided in the mouth of the top container, establishing the retaining of the tubular sleeve in the mouth.

Conventionally, the bottom edge of the tubular sleeve is bevel-edged. This bevel edge has been improved in the following embodiment, so that the bottom edge is horizontal and has a longitudinal, continued decreasing cross sectioned appendix or projection which facilitates partial breaking of the bottom of the top container, without requiring any additional effort. The breaking is only partial because there is a longitudinal recess in the side diametrically opposite the tearing appendix. This recess, which prevents the total breaking of the bottom of the top container, permits the bottom to remain joined to the top container by a fine segment. The torn bottom does not hamper the mixing, because it is flexible, but it does prevent the bottom of the top container from falling inside the bottom container.

The bottom of the top container, which is also made conventionally, can have a perimeter weakening in the inside wall. The weakening can be included in the outside wall, or in both, for the purpose of providing better breaking and preventing formation of particles due to a poor cutting frown appearing. The perimeter weakening also ensures the sealing of the top container, against migration which may exist through the bottom wall of the top container, giving a greater thickness to the center area of the bottom; given that the migration depends on the surface in contact and on the thickness of the same.

Therefore, by use of the present invention and after removal of the seal from the cap, the same can be screwed down effecting the displacement of the tubular sleeve, which partially breaks the bottom of the top container without exerting additional effort and establishes a mutual axial retaining between the cup and the tubular sleeve. Upon effecting the retaining on the peripheral edge of the discoidal wing in the annular recess provided in the mouth of the top container, this structure prevents, upon pressing on the bottom container to effect the required dosage, removal of the top container and/or of the tubular sleeve.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENT INVENTION

Figure 1:
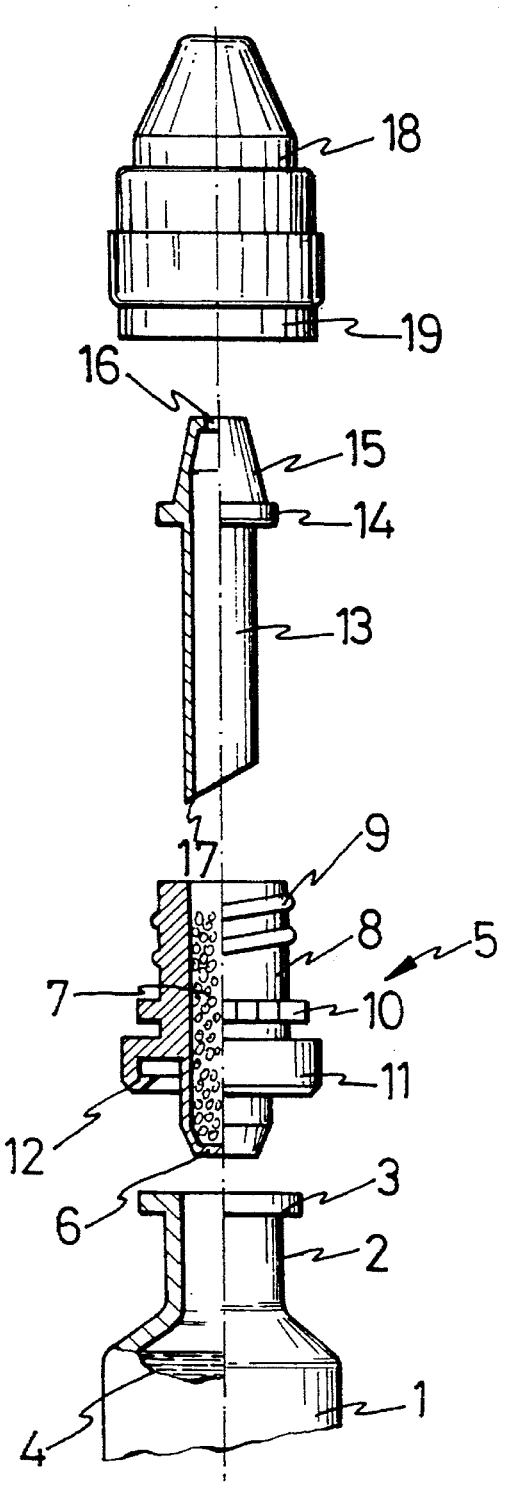
FIG. 1 shows a partially sectioned and exploded view of the different elements that comprise a first embodiment of the present invention.
Figure 2:
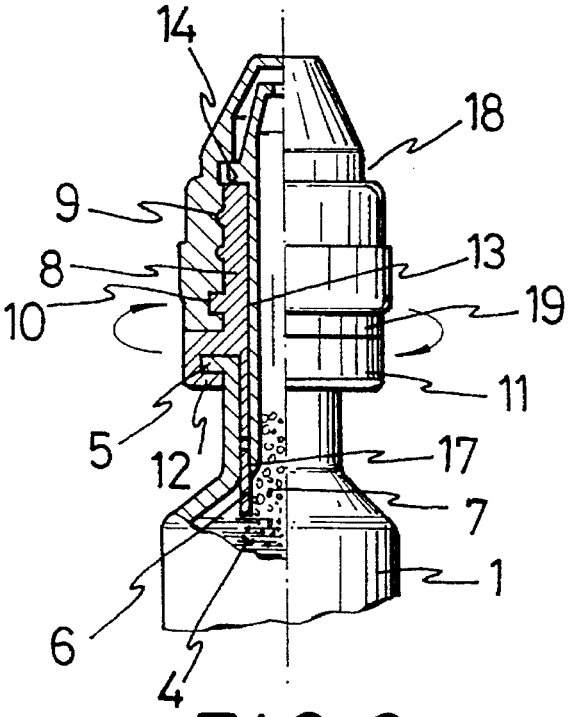
FIG. 2 is a partially sectioned view of the elements of FIG. 1 already assembled and once the seal has been broken.
Figure 3:
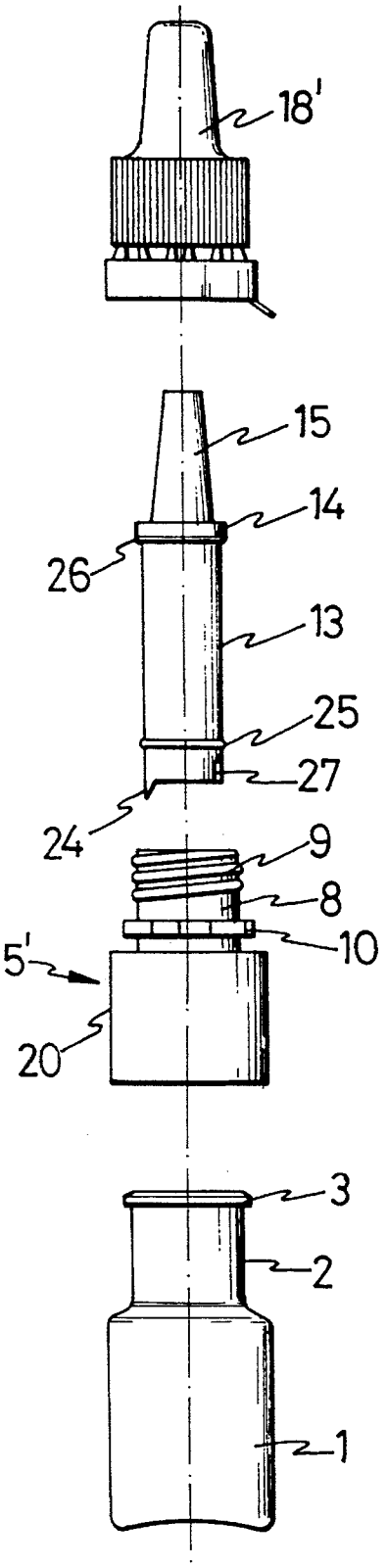
FIG. 3 is an exploded view of each and every one of the elements that comprises the invention, according to a second embodiment.
Figure 4:
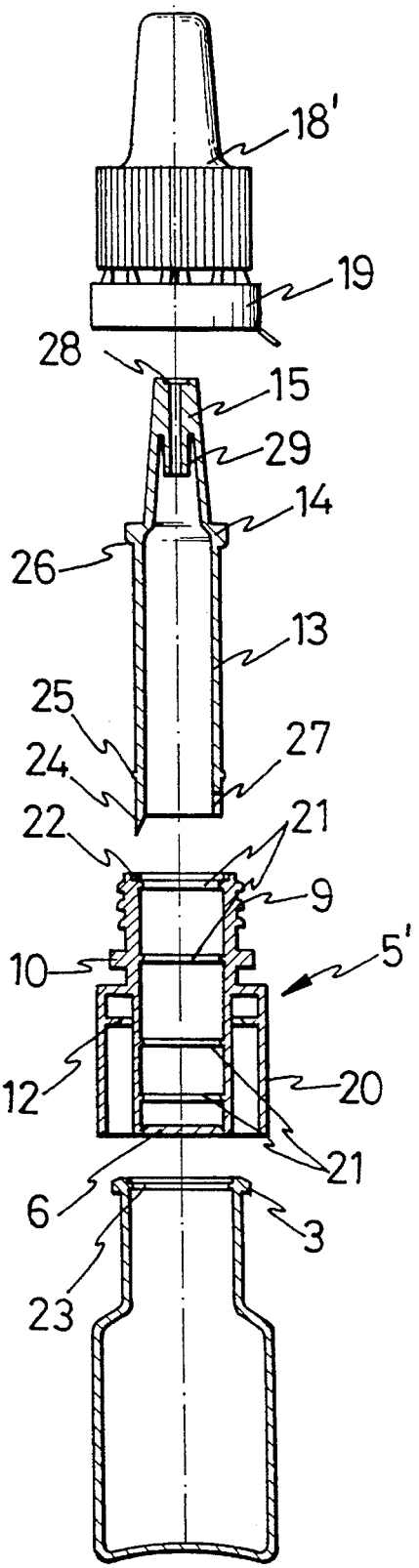
FIG. 4 shows a view equivalent to that of FIG. 3, with the exception that the elements are sectioned except for the cap.
Figure 5:
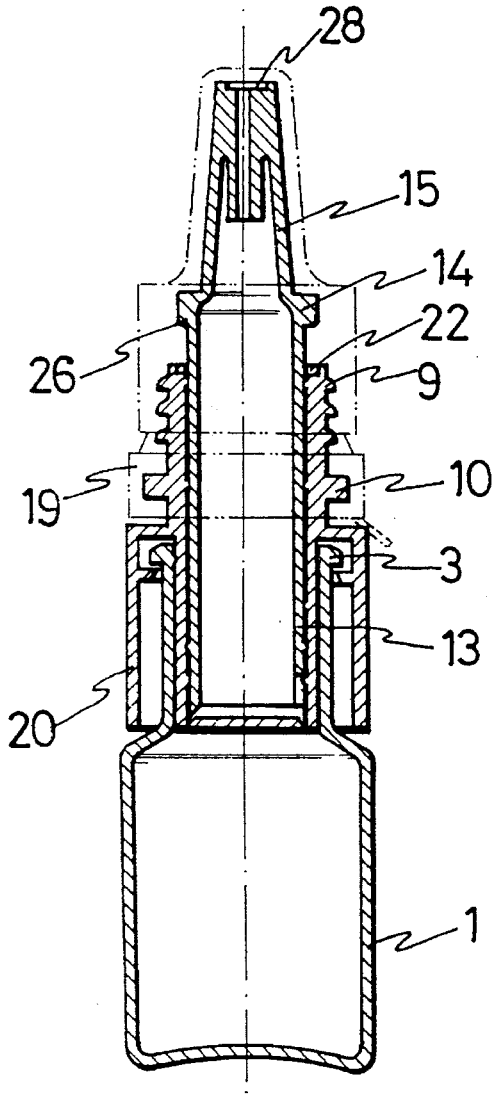
FIG. 5 shows a sectioned view of the second embodiment, in which the elements are assembled and ready for use, without the bottom of the top container having been broken.
Figure 6:
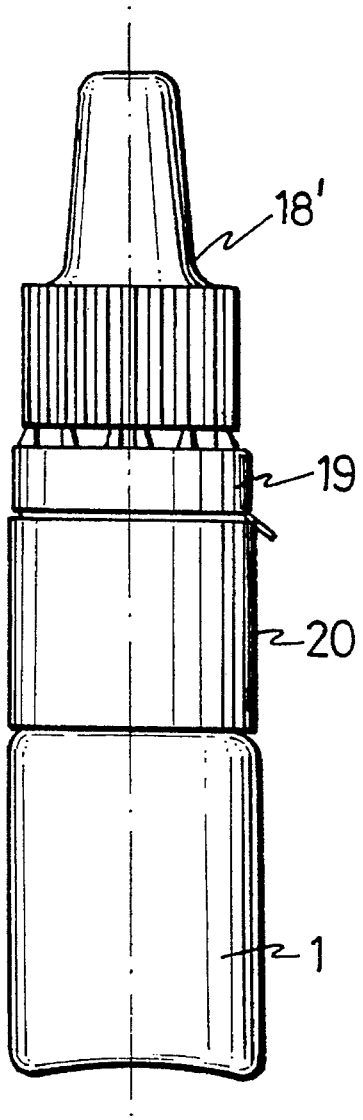
FIG. 6 is a side view without sectioning of FIG. 5.
Figure 7:
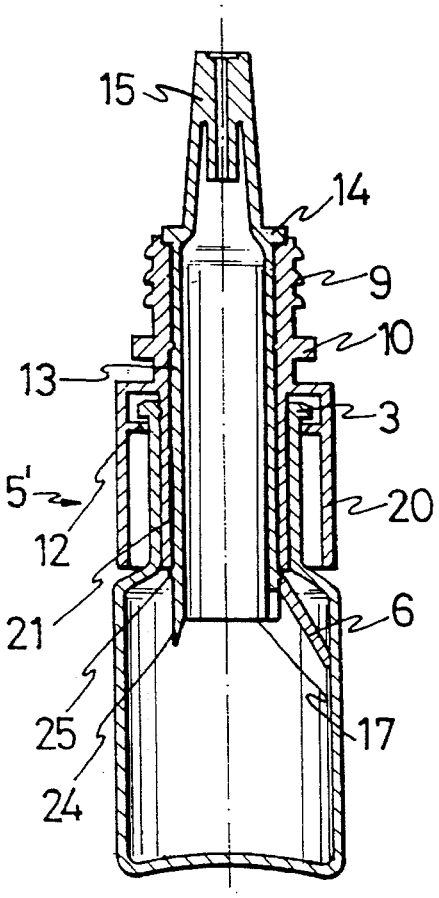
FIG. 7 is a sectioned view equivalent to that of FIG. 5, but with the exception that after having removed the seal, the bottom of the top container has been broken upon screwing down the cap and having subsequently removed the cap.
Figure 8:
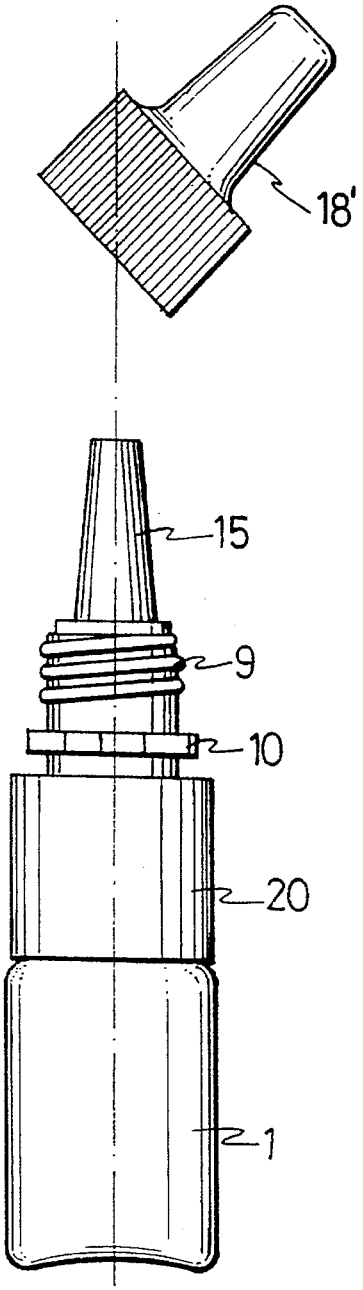
FIG. 8 is a side view without sectioning of FIG. 7.

Referring now to FIG. 1 and 2, a bottom or lower container 1 is illustrated. A product 4 to be mixed is introduced into container 1. Bottom container 1 has a neck 2 in whose mouth an edge 3 has been provided.

A top or upper container 5 is disposed on the mouth of container 1. Container 5 has a small flap, which includes an annular rib 12 which causes top container 5 to be retained on the edge 3 of the bottom container 1.

The top container 5 has a frangible bottom wall 6, which is initially closed and sealed. Thus, a second product 7, which is eventually mixed with the one included in the bottom container 1, is separated from product 4.

The top container 5 extends axially along a neck 8 in which helicoidal threads 9 that permit screwing of a cap 18 are included.

The neck 8 is provided with a perimeter projection 10 that constitutes a retaining means for the seal 19 of the cap 18. The top part of tubular sleeve 13 terminates in a discoidal wing 14 and a truncated-cone shaped portion 15 which can act as a medicine dropper.

The perimeter projection 10 has a plurality of sawteeth, which are complemented by another plurality of sawteeth provided in the interior surface of seal 19 of cap 18. In this way, it is possible to screw cap 18 with its seal 19 until the seal contacts with the small flap of top container 5. In this manner, the locking of the seal 18 in the perimeter projection 10 is produced by the actin of the sawteeth. Upon unscrewing the cap 18 from the top container, the seal 19 of the cap 18 breaks, making it possible to remove seal 19. In this manner, upon screwing the cap 18 back onto the top container 5, cap 18 now comes into contact with the perimeter projection 10. With the movement of cap 18 downwardly, tubular sleeve 13 is pushed axially causing the partial cutting of the bottom 6 by the action of the bottom bevel edge 17. This breaking of seal 6 occurs easily and without any additional effort.

Afterwards it is possible to mix the products 4 and 7, which are administered in a dosed manner upon pressing on the bottom container 1.

In this embodiment there are some problems regarding the sealing and retaining of the elements with respect to the other elements.

In order to solve these problems, a second embodiment is described below, where the perfect retaining between the different elements is established as well as a total sealing between the elements. To obtain these objectives, in the second embodiment, the top container 5 is provided with some transversally placed sealing rings 21 which are complemented with a sealing ring 25 provided close to the bottom edge of the tubular sleeve 13 in the inside of the top container 5'. Thus, total sealing between both containers is made possible.

To facilitate the breaking of the bottom 6 of the top container 5', the bottom of the tubular sleeve 13 has a pointed decreasing cross section longitudinal projection or appendix 24. Diametrically opposite from the appendix 24, a longitudinal recess 27 is disposed. Recess 27 ensures that the total cutting of the perimeter of bottom 6 of the top container 5' is prevented.

The discoidal wing 14 of the tubular sleeve 13, with its peripheral edge, has a certain conicity defining a bevel 26. Bevel 26 is complemented by an annular recess 22 provided in the mouth of the neck 8 of the top container 5'. Thus, upon screwing down the cap, after removing the seal to break the bottom 6 just as it has been described above in the first embodiment, the bevel 26 remains axially retained in the annular recess 22 in the mouth of the neck 8 of the top container 5'. Accordingly, both elements are fastened together in an effective manner.

A sealing ring is disposed in the top part of the neck 2 of the bottom container 1. Sealing ring 23 seals the connection between the top container and the bottom container, once the annular rib 12 is hooked in the edge 3 of the mouth of the bottom container 1.

The truncated-cone shaped portion 15 of tubular sleeve 13, operates as a medicine dropper with controlled dosage, thanks to the use of inside coaxial cylinder 29. In the top end thereof, the tubular sleeve 13 has a recess 28, that mates with an inside projection of the cap 18', to guarantee the sealing of the cap 18' with the tubular sleeve 13.

Therefore, the present invention provides three levels of sealing and prevention mechanisms for improper use. The first level is established between the bottom container 1 and the top container 5, the second between the tubular sleeve 13 and the top container 5, and the third between the cap 18 and the tubular sleeve 13.

Figure 9A:
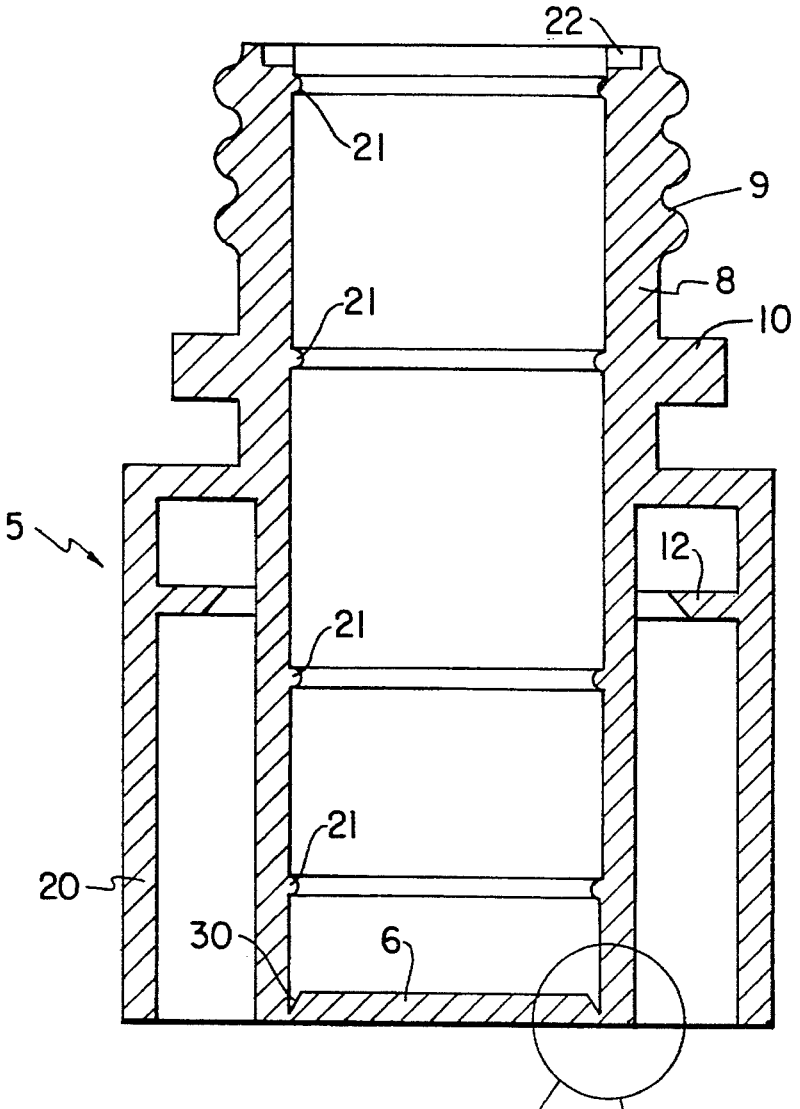
FIG. 9 is a sectioned view of the top container.
Figure 9B:
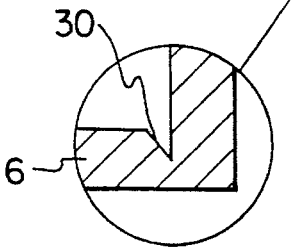
Figure 9C:
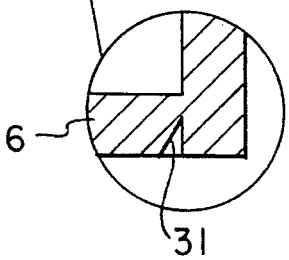

The tearable or frangible bottom 6 of the top container 5 is very thick in its center part, for the purpose of reducing migration through the bottom 6. An inside perimeter weakening 30 and an outside perimeter weakening 31 (See FIG. 9) are provided in bottom wall 6 to prevent adequate tearing, and the production of particles in the same. It should be noted that in the second embodiment, an outside flap 20 is included. Flap 20 extend down approximately half the length of the container I and surrounds substantially all of the neck 2 of the bottom container 1, after effecting the assembly of the different elements.

Both embodiments permit the filling, with product 7, of the bottom container 1, in the first place, sealing it afterwards with the top container 5 or 5', that is filled with product 4, closing the latter with the tubular sleeve 13 and finally screwing on the cap 18, 18'.

The present invention also permits other possible solutions to effect the filling. In the first place of the top container 5, 5', is filled with product 7, closing the latter with the tubular sleeve 13, screwing on the cap 18, 18, and finally filling the bottom container 1, with the product 4 and then sealing the entire device.

Another way to assemble the different elements consists of filling the top container 5, 5', closing it with the tubular sleeve 13, or filling the tubular sleeve 13 (with the cap 18, 18' being previously embossed) and the subsequent sealing of the top container 5, 5'. This versatility of filling procedures permits the packaging of fluids with different viscosities, solids, which may be powder, lyophilized substances or pills.

Having described the presently preferred exemplary embodiment of a new and improved pharmaceutical product container with two separate substances and a mixing device and dosed dispensation, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

We claim:

1. A pharmaceutical product container for housing two separate substances comprising:

a bottom container having means for receiving a first substance, said bottom container having an edge disposed at an open mouth of said bottom container;

a cap;

a top container having means for receiving a second substance, said top container having a frangible bottom wall, said top container having a flap extending radially outwardly, said flap includes an annular rib, said annular rib having means for retaining said edge of said bottom container, said top container having a neck portion extending axially remote from said bottom wall, said neck having a helical thread to receive said cap, said neck including a plurality of radially extending toothed projections about its perimeter;

a tubular sleeve being disposed within said top container, said tubular sleeve being axially moveable with respect to said top container, said tubular sleeve having a first end and a second end, said first end having means for partially cutting said bottom wall of said top container upon rotation of said cap onto said neck to create axial movement of said tubular sleeve in a first direction, said second end terminating with a radially protruding wing and a truncated-cone shaped portion, said truncated-cone shaped portion having means for functioning as a medicinal dropper; and a seal being connected to said cap with a perforated connection, said seal including a plurality of radially extending toothed projections about its perimeter which mate with said plurality of projections in said neck such that upon rotation of said cap off of said neck, said perforated connection breaks and said seal can be removed, said cap can then be rotated onto said neck to effect said cutting of said bottom wall.

2. The container according to claim 1, wherein said partial cutting means includes an edge of said tubular sleeve having a bevelled edge.

3. The container according to claim 1, wherein said partial cutting means includes an edge of said tubular sleeve having a pointed longitudinal projection which has a decreasing cross section in a downward direction.

4. The container according to claim 3, wherein a longitudinal recess is disposed in said tubular sleeve diametrically opposite to said pointed longitudinal projection, said recess preventing said bottom wall from being completely separated from said top container when said bottom wall is cut.

5. The container according to claim 1, wherein one of said bottom wall and said tubular sleeve includes a perforated line to facilitate the cutting thereof.

6. The container according to claim 1, wherein said bottom wall has a thick center region and has a reduced wall thickness about its perimeter to permit adequate cutting of said bottom wall without producing fragmented particles.

7. The container according to claim 1, wherein said flap surrounds a neck portion of said bottom container.

8. The container according to claim 1, wherein said means for functioning as a medicinal dropper includes a cylinder disposed coaxially within said tubular sleeve.

9. The container according to claim 1, wherein said radially protruding wing of said tubular sleeve has an outer peripheral edge having a conical shape to define a bevel, said neck of said top container having an annular recess disposed in a mouth of said top container to receive and retain said bevel thereby retaining said tubular sleeve in said top container.

10. The container according to claim 1, wherein said bottom container has a sealing ring which seals with an outside wall of said top container, said sealing ring being reinforced by said edge of said bottom container when retained by said annular rib, said tubular sleeve has a sealing ring that cooperates with at least one sealing ring disposed on an inner surface of said top container to effect a seal between said tubular sleeve and said top container after said cutting.

11. The container according to claim 10, wherein said tubular sleeve has on its second end a recess which mates with a corresponding projection on said cap to permit sealing between said cap and said tubular sleeve.

* * * * *